US005189763A

United States Patent [19]

Voumard

[11] Patent Number: 5,189,763

[45] Date of Patent: Mar. 2, 1993

[54] STRAP CLASP

[75] Inventor: Bertrand P. Voumard, Chexbres, Switzerland

[73] Assignee: Isafrance, Villers-de-Lac, France

[21] Appl. No.: 728,144

[22] Filed: Jul. 10, 1991

[30] Foreign Application Priority Data

Jul. 13, 1990 [CH] Switzerland ..... 2347/90

[51] Int. Cl.[5] ..... A44B 11/22

[52] U.S. Cl. ..... 24/175; 24/163 R; 24/176

[58] Field of Search ..... 24/163 R, 175, 176, 24/177, 186, 181, 573 A, 16 PB

[56] References Cited

U.S. PATENT DOCUMENTS

| | | | |
|---|---|---|---|
| 1,018,880 | 2/1912 | Cooper | 24/175 X |
| 1,543,399 | 6/1925 | Smith . | |
| 3,088,184 | 5/1963 | Bittner . | |
| 3,209,423 | 10/1965 | Cattin . | |
| 4,141,198 | 2/1979 | Gaertner | 24/177 X |
| 4,233,712 | 11/1980 | Horst et al. . | |

FOREIGN PATENT DOCUMENTS

| | | | |
|---|---|---|---|
| 958013 | 2/1957 | Fed. Rep. of Germany | 24/175 |
| 1006363 | 4/1957 | Fed. Rep. of Germany | 24/175 |
| 1363383 | 5/1964 | France . | |
| 1376719 | 9/1964 | France . | |
| 328836 | 5/1958 | Switzerland . | |
| 2028410 | 3/1987 | United Kingdom | 24/175 |

*Primary Examiner*—James R. Brittain
*Attorney, Agent, or Firm*—Oliff & Berridge

[57] ABSTRACT

The clasp includes a first part composed of a base plate surmounted by at least one stud, the first part being inserted in one or more holes of two superimposed lengths of a watch strap, and a second part surrounding the two lengths of watch strap. The top portion of the second part is provided with a longitudinal slot extending to at least one edge of the top portion in which a notch is intended to receive the end of a stud. This clasp simplifies the manufacture of the watch strap and avoids any wear and tear on the watch strap during use thereof.

13 Claims, 3 Drawing Sheets

STRAP CLASP

This invention relates to fastening devices, and more particularly to a clasp for a strap. Leather or plastic straps, especially for wrist watches, are usually fastened by means of a buckle and a buckle-tongue fixed to a first length of the strap, the tongue being inserted in a hole made in a second length of the strap. This very conventional type of clasp is generally supplemented by one or two loops for holding down the loose end of the second length.

Such a prior art clasp presents numerous drawbacks: first of all, during manufacture, since the two lengths of the strap are not identical, they must be produced separately; in the case of plastic straps, this calls for two different molds, and for two different hollow punches in the case of leather straps. Furthermore, the holding loop or loops, as well as the buckle and tongue, must be secured to one of the strap lengths, which is a relatively expensive operation. This system then also presents several drawbacks in use, in particular that it requires substantial bending of one length of the strap in order to insert or withdraw the tongue; in time, this causes wear and tear on the strap. Moreover, if the wrist watch is fastened around a slender wrist, a considerable length of the watch strap is left hanging loose, which diminishes its attractiveness.

It is an object of this invention to provide an improved strap clasp which eliminates the aforementioned drawbacks of prior art designs, i.e., to simplify manufacture by providing two absolutely identical lengths of strap, by providing a clasp requiring only a minimum of parts to be secured to one of the lengths by an expensive operation, leading to a notable reduction of the cost of production and, during use, making possible above all a precise adjustment of length and reliable fastening, without wear and tear on any of the components.

A further object of the invention is to provide such a strap clasp which is, in addition, attractive.

To this end, the clasp according to the present invention is made up of a first part comprising a flat base plate on which one or more cylindrical studs are fixed perpendicularly, the studs being introduced into one or more aligned holes in two superimposed lengths of strap, the base plate resting against the underside of the lower length of strap, and of a second part transversely surrounding the two superimposed lengths of strap, this second part comprising a longitudinal slot either on the top portion thereof which is superimposed upon the top portion of the upper length of strap, or on the bottom portion thereof which is superimposed upon the bottom portion of the lower length of strap, as well as a notch contrived in the slot, in order to grip either one of the studs which extends beyond the top portion of the upper length of strap or a protuberance contrived on the base plate.

Figure 2:
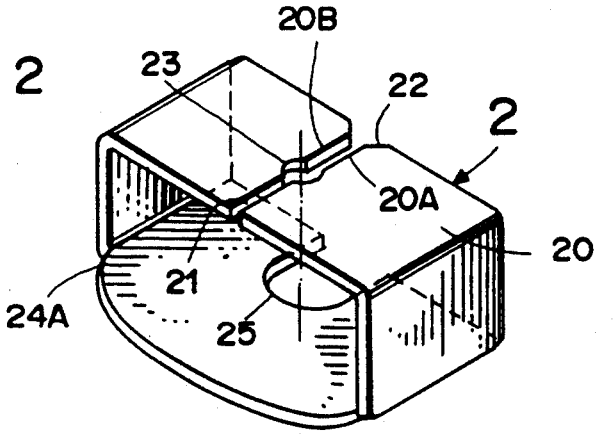
Figure 1:
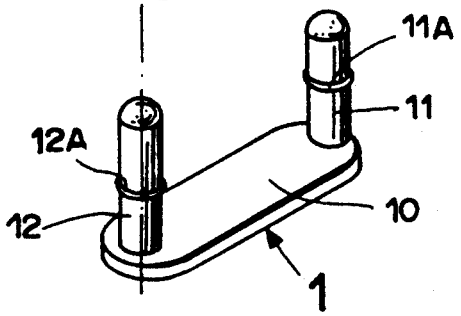
Figure 3:
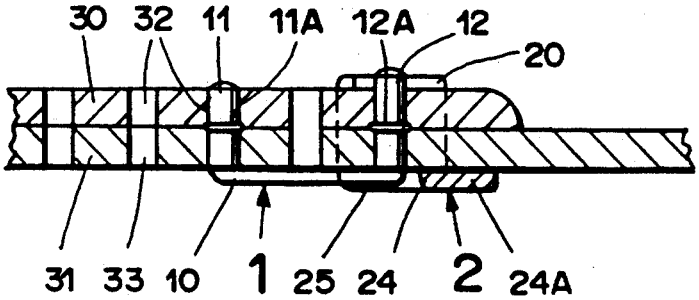
Figure 4:
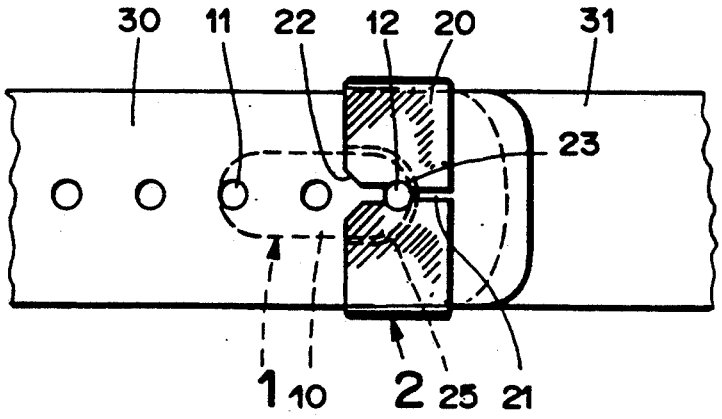
Figure 5:
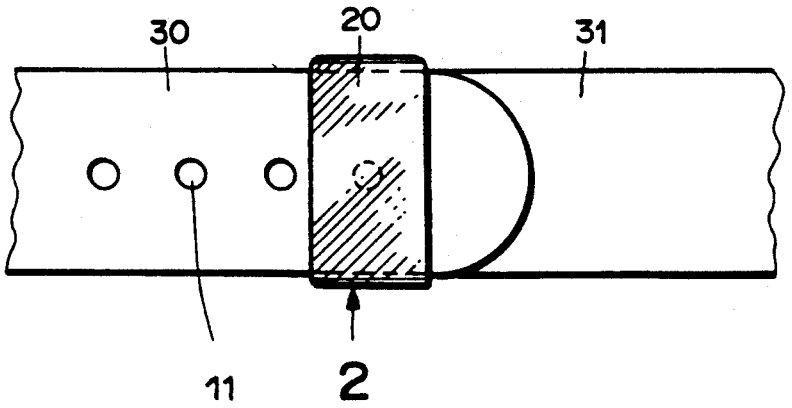
Figure 6:
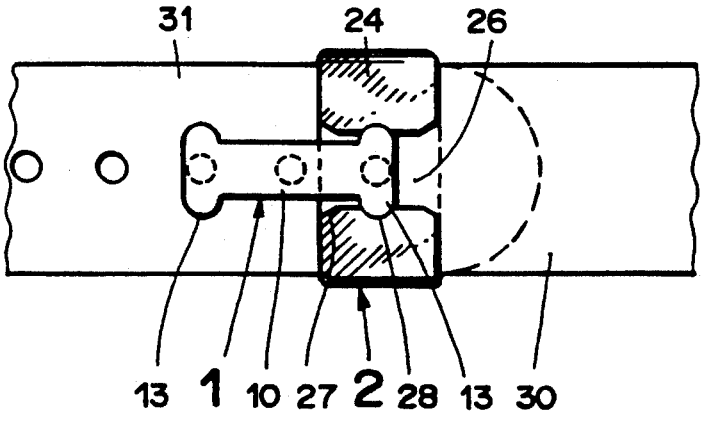
Figure 7:
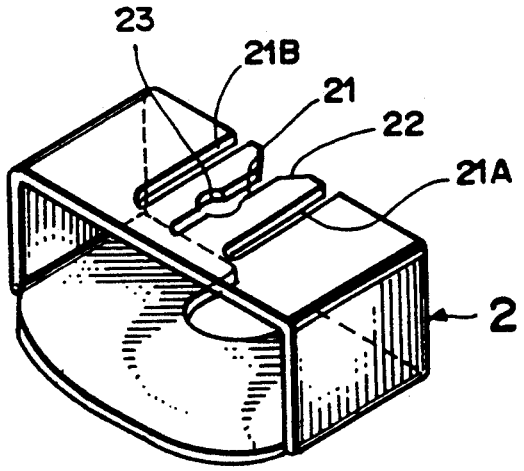
Figure 8:
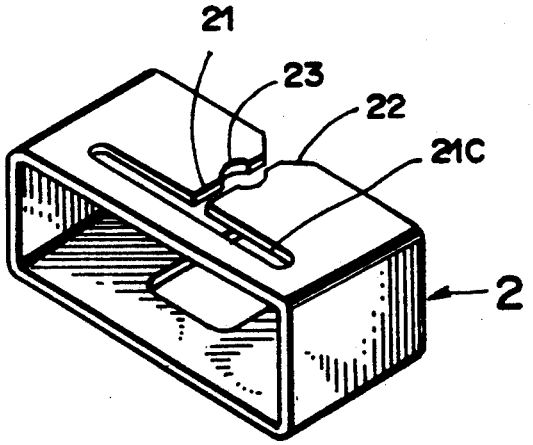

Preferred embodiments of the invention will now be described in detail with reference to the accompanying drawings, in which:

FIG. 1 is a perspective view of the first part of the clasp,

FIG. 2 is a perspective view of the second part of the clasp in a first embodiment of the invention, FIG. 3 is a longitudinal section through a clasp mounted on two lengths of a watch strap, FIG. 4 is a top plan view of the preceding clasp, FIG. 5 is a top plan view of a clasp in a second embodiment of the invention, FIG. 6 is a bottom view of the clasp of FIG. 5, FIG. 7 is a perspective view of the second part of the clasp in a further embodiment of the invention, and FIG. 8 is a perspective view of the second part of the clasp in another embodiment of the invention.

A first part 1 of the invention clasp is shown in perspective in FIG. 1. Part 1 consists of a flat base plate 10, shown here as being oval but which may be of any shape. On base plate 10 there are two cylindrical studs 11 and 12, fixed there in any manner suitable to the method of manufacture and to the material used for part 1, disposed perpendicular to plate 10, the spacing between studs 11 and 12 corresponding to the spacing between holes in a watch strap in which these studs are to be inserted. In this embodiment, one of the studs is longer than the other, as will be explained below. Each of the studs 11 and 12 includes a slight bulge in the form of a transverse collar, 11A and 12A, respectively, the outside diameter of which is very slightly greater than that of the stud. The function and axial position of these collars will be explained below. Although the top of each stud 11 and 12 is shown here as being hemispherical, it may just as well be flat or pointed.

A second part 2 of the invention clasp is shown in perspective in FIG. 1. Part 2 is tubular and of rectangular cross-section, the inner short side being very slightly greater than the thickness of two superimposed lengths of the watch strap, and the inner long side being very slightly greater than the width of the lengths of watch strap, so that when part 2 is in place, it can slide freely over two superimposed lengths of the watch strap. The top portion 20 of part 2 is provided with a longitudinal slot 21 extending to at least one edge of the top portion 20 separating portion 20 into two jaws 20A and 20B capable of opening slightly, the body of part 2 acting as a spring. A round-off 22 is disposed at the mouth of slot 21, and a circular notch 23 is disposed approximately halfway along slot 21. The size and shape of round-off 22 are such that when stud 12 of part 1 is introduced perpendicularly into slot 21, jaws 20A and 20B move apart to allow stud 12 to pass, so that it can slide along slot 21 to notch 23, which has the same diameter as stud 12, where the latter remains gripped, jaws 20A and 20B closing again owing to the spring effect of part 2. The bottom portion 24 of part 2 includes a recess 25 of a shape adapted to receive part of base plate 10 of part 1 when parts 1 and 2 are connected. Since bottom portion 24 is weakened by the presence of recess 25, the width of this portion may be increased slightly, as shown at 24A, so that the solidity of part 2 is ensured.

The complete clasp illustrated in FIG. 3 shows how part 1 and part 2 fasten two superimposed lengths 30 and 31 of a watch strap. Each of these lengths of watch strap includes a series of transpierced, equidistant holes 32, 33 along its longitudinal axis. First part 2 is slipped over watch-strap length 31, with portion 20 upward and round-off 22 facing the end of length 31; then, by pressing on base plate 10 of part 1, studs 11 and 12 are inserted in two of the holes 33, which may be adjacent or have one or more holes in between (in the case illustrated, there is one hole in between); by pressing firmly on base plate 10, collars 11A and 12A are forced through the respective holes 33 of lower length 31 so that they hold part 1 tightly to lower watch-strap length 31. It is thus seen that the distance separating the upper surface of base plate 10 from collars 11A and 12A must be equal to the thickness of watch-strap length 31. Next, upper watch-strap length 30 is placed upon lower length 31, the top portions of studs 11 and 12 being inserted in two of the holes 32 of length 30 so that the watch strap is as tight as desired. It then suffices to slide part 2 toward stud 12, to push the end of stud 12 into round-off 22, then into slot 21, and finally to lock part 1 into part 2 when stud 12 is gripped in circular notch 23. It is thus seen that stud 11 must be short enough so that the top thereof does not extend beyond the top surface of length 30, whereas stud 12 must be long enough so that it does extend beyond that top surface in order to be gripped by part 2.

FIG. 4, a top view of the clasp of FIG. 3, shows clearly how stud 12 is engaged in slot 23.

Various modifications of this first embodiment may be described: in particular, if base plate 10 of part 1 is thin enough, it is not absolutely necessary to provide recess 25 in portion 24 of part 2, this portion then resting upon base plate 10; in that case, extension 24A is no longer necessary either. Another modification may consist in providing a slightly longer part 2, slot 21 of which includes two circular notches 23 so as to grip both studs 11 and 12, which are then equally long and extend beyond the top surface of watch-strap length 30. Furthermore, although the inventive clasp has been described as having two studs inserted in two holes of each length of the watch strap, it would work just as well with a single stud or more than two, inserted in the matching hole or holes of the lengths of the watch strap.

FIGS. 5 and 6 are top and bottom views, respectively, of a second embodiment of the inventive watch-strap clasp. In this case, base plate 10 is elongated and comprises one or more protuberances 13 which may be situated at any location on plate 10, e.g., at both ends as illustrated in FIG. 6. A single protuberance situated midway along the length of plate 10 would do just as well. In this case, studs 11 and 12 are equally long and do not extend beyond the top surface of upper watch-strap length 30. Bottom portion 24 of part 2 includes a slot 26 having a round-off 27 and a notch 28 into which protuberance 13 may be slid in order to lock parts 1 and 2 together, as before. Inasmuch as top portion 20 of part 2, which portion is visible, does not have any slot, this second embodiment of the inventive clasp is more attractive than the previous embodiment.

Another embodiment of the invention, derived from the first embodiment (FIG. 2), is depicted in FIG. 7. In this case, longitudinal slot 21 does not extend all the way across the top portion of part 2 but only partway across, in order not to weaken that part too greatly. To allow insertion of the stud, two lateral slots 21A and 21B are disposed parallel to slot 21, one on either side, so that the two sides of central slot 21 act as springs. As previously, central slot 21 is provided with a round-off 22 and a notch 23.

FIG. 8 shows a further embodiment of the invention in which part 2 is derived from the first embodiment (FIG. 2). As in the preceding instance, longitudinal slot 21 extends only partway across the top portion of part 2, another part 21C of slot 21, perpendicular to the previous one and disposed at the end of slot 21 opposite the end having round-off 22 (i.e., the mouth of the slot), being contrived on part of the length of the top portion of part 2.

Thus, the strap clasp according to the present invention, particularly for a wrist watch, fully meets the specified requirements, viz., manufacture of the lengths of strap is simplified inasmuch as each of them is absolutely identical and can be produced from the same mold or the with the same hollow punch; no expensive assembly operation is necessary for putting the clasp on the strap; furthermore, during use, it is not necessary to bend one of the lengths of the strap around the clasp, which leads to wear and tear on the strap; and because the inventive clasp can be disposed anywhere on the strap where the holes of each length are superimposed, it is very easy to place it in such a way that the loose end is of minimum length, so that the loop or loops necessary with prior art fastening devices may be eliminated. The inventive clasp is attractive, all the more so as it may be made of any material having sufficient elasticity to produce the mentioned spring effect, e.g., of common or precious metals or of plastic. Although the clasp has been described as applied to a watch strap, it will be understood that it may equally well be applied to any sort of strap, and more generally to the fastening of two strap-like joining elements, such as belts.

What is claimed is:

1. A clasp for a strap, comprising:

a first part having a flat base plate and at least one cylindrical stud fixed perpendicular to said base plate, two superimposed upper and lower lengths of said strap having one or more aligned holes therein for receiving said at least one stud, said base plate resting against the underside of the lower length of said strap, and a second part surrounding said two superimposed lengths of strap transversely and having a top portion resting upon the upper length of said strap, said at least one stud extending beyond said top portion, a bottom portion, and a first longitudinal slot in said top portion and extending to at least one edge of said top portion and including a notch for slidably receiving said at least one stud.

2. The clasp of claim 1, wherein said at least one stud comprises a plurality of cylindrical studs of different lengths.

3. The clasp of claim 1, wherein the longitudinal first slot extends over only part of the width of said top portion of said second part, and further comprising two further slots disposed parallel to and one on each side of said first longitudinal slot and extending over the same part of the width of said top portion as said first slot.

4. The clasp of claim 3, wherein said at least one stud comprises a plurality of cylindrical studs of different lengths.

5. The clasp of claim 1, wherein the first longitudinal slot has a round-off at the at least one edge of the top portion, said first longitudinal slot extending over only part of the width of said top portion of said second part, and a transverse slot disposed perpendicular to said first longitudinal slot at the end of said first longitudinal slot opposite said round-off and extending over part of the length of said top portion of said second part.

6. The clasp of claim 5, wherein said at least one stud comprises a plurality of cylindrical studs of different lengths.

7. The clasp of claim 1, wherein said at least one cylindrical stud includes a radial collar situated at a distance from said base plate substantially corresponding to the thickness of said strap for fixing said first part of said lower length of strap.

8. A clasp for a strap, comprising:

a first part having a flat base plate, at least one cylindrical stud fixed perpendicular to said base plate, and a protuberance projecting laterally from said base plate, two superimposed upper and lower length of said strap having one or more aligned holes therein for receiving said studs, said base plate resting against the underside of the lower length of said strap, and a second part surrounding said two superimposed lengths of strap transversely and having a top portion, a bottom portion resting against the underside of the lower length of said strap, and a longitudinal slot made in said bottom portion including a notch for gripping said protuberance.

9. The clasp of claim 8, wherein said at least one stud comprises a plurality of cylindrical studs of uniform length.

10. A clasp for a strap, comprising:

a first part having a flat base plate and at least one cylindrical stud fixed perpendicular to said base plate, two superimposed upper and lower lengths of said strap having one or more aligned holes therein for receiving said at least one stud, said base plate resting against the underside of the lower length of said strap, and a second part surrounding said two superimposed lengths of strap transversely and having a top portion resting upon the upper lengths of said strap, said at least one stud extending beyond said top portion, a bottom portion, and a first longitudinal slot having a notch for gripping the at least one stud, the first longitudinal slot extending over only part of the width of said top portion of said second part, and second and third longitudinal slots disposed parallel to and one on each side of said first slot and extending over the same part of the width of said top portion as said first slot.

11. The clasp of claim 10, wherein said at least one stud comprises a plurality of cylindrical studs of different lengths.

12. A clasp for a strap, comprising:

a first part having a flat base plate and at least one cylindrical stud fixed perpendicular to said base plate, two superimposed lengths of said strap having one or more aligned holes therein for receiving said at least one stud, said base plate resting against the underside of the lower length of said strap, and a second part surrounding said two superimposed lengths of strap transversely and having a top portion resting upon the upper length of said strap, said at least one stud extending beyond said top portion, a bottom portion, a longitudinal slot in the top portion of the second part and having a round-off at an end thereof and a notch for gripping the at least one stud, said longitudinal slot extending over only part of the width of said top portion of said second part, and a transverse slot disposed perpendicular to said longitudinal slot at an end of said longitudinal slot opposite said round-off and extending over part of the length of said top portion of said second part.

13. The clasp of claim 12, wherein said at least one stud comprises a plurality of cylindrical studs of different lengths.

* * * * *